United States Patent [19]

Hiester

[11] 4,185,974

[45] Jan. 29, 1980

[54] INTEGRAL FILTER CAGE AND LID FOR CANNISTER TYPE VACUUM CLEANER

[75] Inventor: Kenneth R. Hiester, Cogan Station, Pa.

[73] Assignee: Shop-Vac Corporation, Williamsport, Pa.

[21] Appl. No.: 860,822

[22] Filed: Dec. 15, 1977

[51] Int. Cl.[2] ..... B01D 46/00

[52] U.S. Cl. ..... 55/216; 55/472; 15/327 D

[58] Field of Search ..... 55/215, 216, 467, 471–473, 55/498; 15/327 D, 353

[56] References Cited

U.S. PATENT DOCUMENTS

| | | | |
|---|---|---|---|
| 2,049,603 | 8/1936 | Dietenberger | 55/471 |
| 2,649,927 | 8/1953 | Ortega | 15/353 |
| 3,045,412 | 7/1962 | Bowman | 55/471 |
| 3,082,465 | 3/1963 | Wood | 55/471 |
| 3,296,777 | 1/1967 | Jackson et al. | 55/216 |
| 3,597,902 | 8/1971 | Williams | 55/467 |
| 3,775,951 | 12/1973 | Eicholz et al. | 55/467 |

*Primary Examiner*—Bernard Nozick

*Attorney, Agent, or Firm*—Ostrolenk, Faber, Gerb & Soffen

[57] ABSTRACT

In a cannister or tank type vacuum cleaner which uses a generally cylindrical filter element that is fitted around a generally cylindrical filter cage, the cage is an integral plastic molding with the lid that closes the tank of the vacuum cleaner; the vacuum cleaner motor sits atop the lid; the lid is removably sealed to the cannister; inside the filter cage, there is a freely floating ball, which floats up through the cage as the tank becomes filled to seal the air outlet to the motor.

27 Claims, 7 Drawing Figures

INTEGRAL FILTER CAGE AND LID FOR CANNISTER TYPE VACUUM CLEANER

The present invention relates to the lid and filter cage for a cannister or tank type vacuum cleaner. The invention is particularly useful for a vacuum cleaner used for collecting liquid or wet materials.

BACKGROUND OF THE INVENTION

Cannister or tank type vacuum cleaners are used for collecting various types of material, both dry and wet, and they are sometimes even used for collecting water or other liquids.

In a typical cannister or tank vacuum cleaner, the tank has a lid over it and the vacuum cleaner motor is supported on the lid. The vacuum cleaner motor drives an impeller fan. The fan has an inlet side that communicates into the tank and draws a vacuum there.

In the usual cannister vacuum cleaner, the lid is a separate disc or plate that is attached and perhaps clamped over the open top of the cannister. The lid is typically a flat surfaced disc. To provide the lid with the strength needed for supporting the motor, especially while it is in operation, and for supporting the filter assembly, the lid is typically formed of a strong, relatively rigid metal disc. The periphery of the disc is shaped to sealingly engage the upper end of the side walls of the tank. A hole is cut through the lid just beneath the mounting for the motor and this hole provides communication between the interior of the tank and the impeller fan driven by the motor.

A filter assembly is interposed between the interior of the tank and the inlet to the impeller fan for capturing particulate matter so that it does not escape into and past the fan and is not expelled from the vacuum cleaner. In the typical tank vacuum cleaner, directly beneath the lid of the tank and at the inlet to the impeller fan, there is a filter support for supporting a replaceable filter element. Typically, the filter support is in the form of a filter cage which is generally cylindrically shaped, and the filter element is in the form of a cylindrical annulus which is removably press fit over the filter cage. The annular sides of the filter cage are defined by vertical ribs, shaped and placed to support the surrounding filter element, yet spaced apart so as not to interfere with air flow. The bottom of the filter cage is closed off.

In situations where liquid or wet materials are being collected, it is necessary that the flow out of the tank and into the vacuum cleaner motor be halted before the liquid or wet material is drawn into the motor.

For supporting the particulate material filter element, the filter cage of the typical cannister vacuum cleaner is secured to the underside of the lid around the hole through the lid. Typically, the filter cage is a molded plastic unit with an annular collar at its upper edge. This collar is bolted to the underside of the lid. The separate formation of the lid and filter cage and the later attachment together of these elements necessitates separate formation and attachment procedures, which it would be desirable to eliminate or reduce.

Inside the filter cage, there is a float element that sits on the base of the filter cage and that is adapted to float up through the filter cage once the level of liquid in the tank rises above the bottom of the filter cage. The float element comprises a freely floating ball or cylinder. The float element eventually floats up high enough to seal the inlet to the impeller fan. Further operation of the vacuum cleaner is blocked until the tank is emptied of collected material. At the same time, the filter element may also be replaced.

The bottom end of the filter cage is closed off by a bottom cover. A separate inlet grid element is attached across the hole through the tank lid for permitting air to pass through the hole in the lid while also enclosing the top end of the filter cage.

SUMMARY OF THE INVENTION

It is the primary object of the present invention to simplify the construction and assembly of the lid and filter cage of a cannister type vacuum cleaner.

It is another object of the present invention to provide an adequately strong lid for a cannister type vacuum cleaner.

It is another object of the invention to provide such a lid which can be effectively sealingly attached to the vacuum cleaner tank.

It is a further object of the present invention to provide an effective filter cage for a cannister type vacuum cleaner.

It is yet another object of the invention to provide a combined lid and filter cage assembly for a cannister type vacuum cleaner.

According to the present invention, the lid and the filter element support, here a filter cage, of the cannister type vacuum cleaner are a single, integral molding, of a plastic material, such as polypropylene. A main hole through the tank lid communicates between the tank and the impeller fan. When the fan operates, it tries to draw a vacuum in the tank.

For convenience of molding and for conservation of material, the lid is relatively thin between its top and bottom surfaces. To strengthen the lid, it is provided with a series of reinforcing ribs across at least one of its surfaces, preferably on its underside. The ribs comprise an array of generally radially extending ribs located at spaced intervals around the lid. The ribs on the lid radiate from the main hole through the lid to the periphery of the lid.

In certain embodiments of vacuum cleaners, an intake inlet hole to the tank is also defined in the lid. Where the intake inlet hole is through the lid, both of the main hole that communicates between the interior of the tank and the impeller fan and the intake hole are eccentrically placed on the lid and are spaced apart. For rigidifying the lid in such a circumstance, a further, generally arcuately shaped, reinforcing rib is also defined on the lid for strengthening the radially wider section of the lid. This rib intersects the radially extending ribs in its parth and also intersects the intake inlet hole.

Integrally molded at and extending down from the underside of the lid around the periphery of the main fan inlet hole through the lid is the annular filter cage. The cage is comprised of an upper end annular, cylindrical collar projecting down a short distance from the underside of the tank lid. The cage is further comprised of a plurality of rigidifying ribs extending down from the filter cage collar and spaced at regular angular intervals around the filter cage. At their bottom ends, all of the ribs are secured to and support a bottom plate which closes off the bottom of the filter cage.

Inside the filter cage and seated on its bottom, there may be a float element guide sleeve for containing and for guiding motion of the float element up through the filter cage upon liquid or wet material filling the tank.

The upper end of the filter cage at the main fan inlet hole is closed off by an inlet grid, which has openings to permit free exit of filtered air through the main fan inlet hole, but which blocks the float element from leaving the filter cage. The inlet grid element is a separate insert for the main fan inlet hole, which is emplaced over that hole prior to mounting of the motor on the lid. The motor and impeller fan are thereafter secured on the lid over the inlet grid and the main fan inlet hole of the lid.

Other objects and features of the present invention will become apparent from the following description of a preferred embodiment of the invention, which is taken in conjunction with the accompanying drawings.

DESCRIPTION OF A PREFERRED EMBODIMENT

Figure 7:
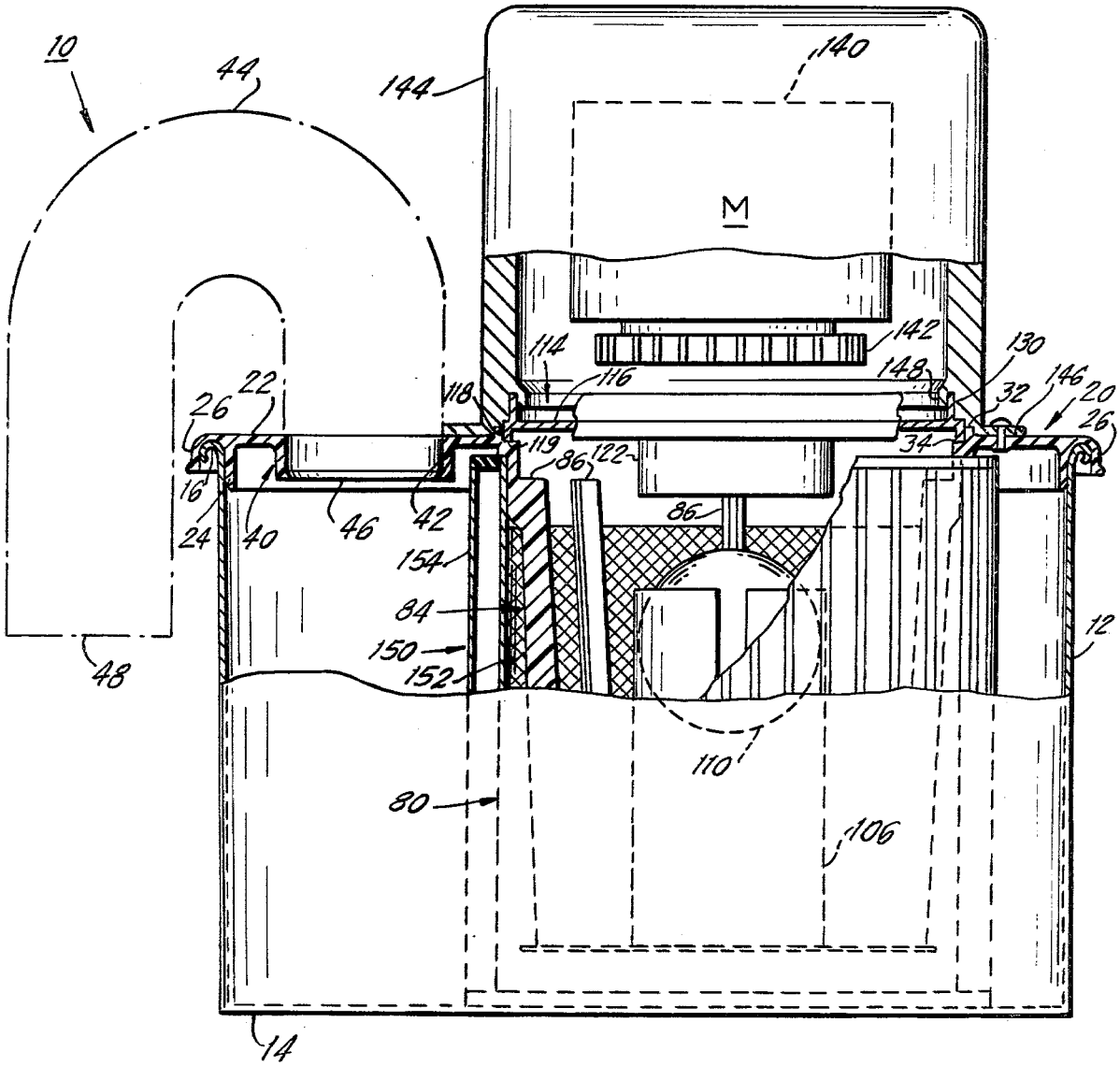
FIG. 7 is a cross-sectional view, partially broken away, showing a cannister type vacuum cleaner provided with the integral lid and filter cage assembly according to the present invention.

A cannister type vacuum cleaner 10 is illustrated in FIG. 7. It comprises a conventional cylindrical metal tank 12 which is conventionally sealed closed at its bottom 14. The upper peripheral edge 16 of the tank 12 is folded down to form an annular engageable bead or rib.

Figures 1, 5, 6:
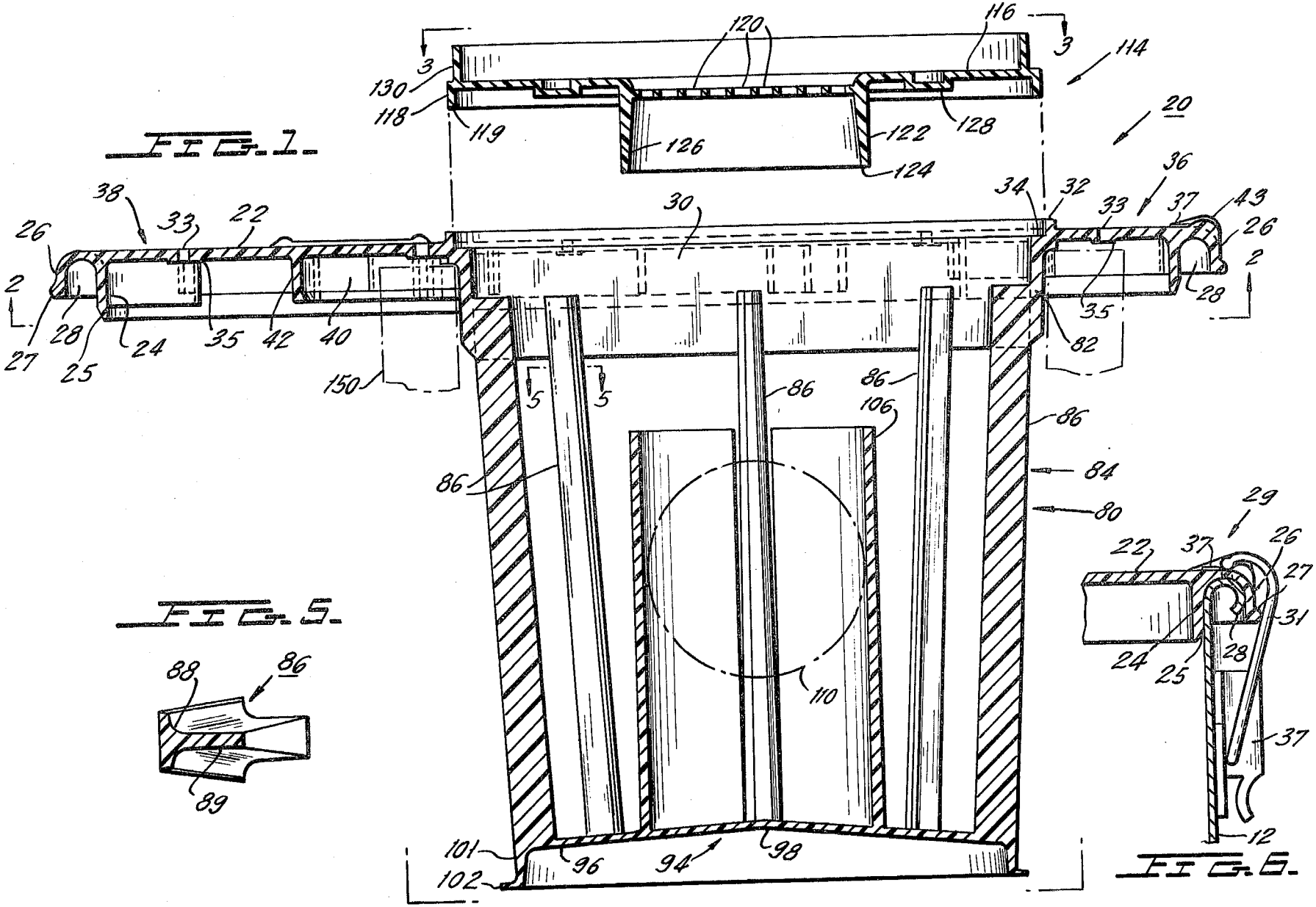
FIG. 1 is a side elevational, cross sectional view of an integral lid and filter cage assembly of the present invention for use in a cannister type vacuum cleaner, and showing an inlet grid exploded away from the integral assembly.
FIG. 5 is a cross-sectional view of a rib of the filter cage along the line and in the direction of arrows 5 in FIG. 1.
FIG. 6 is an enlarged fragmentary view of the lid of FIG. 1 showing the clamp at the periphery of the lid.
Figure 2:
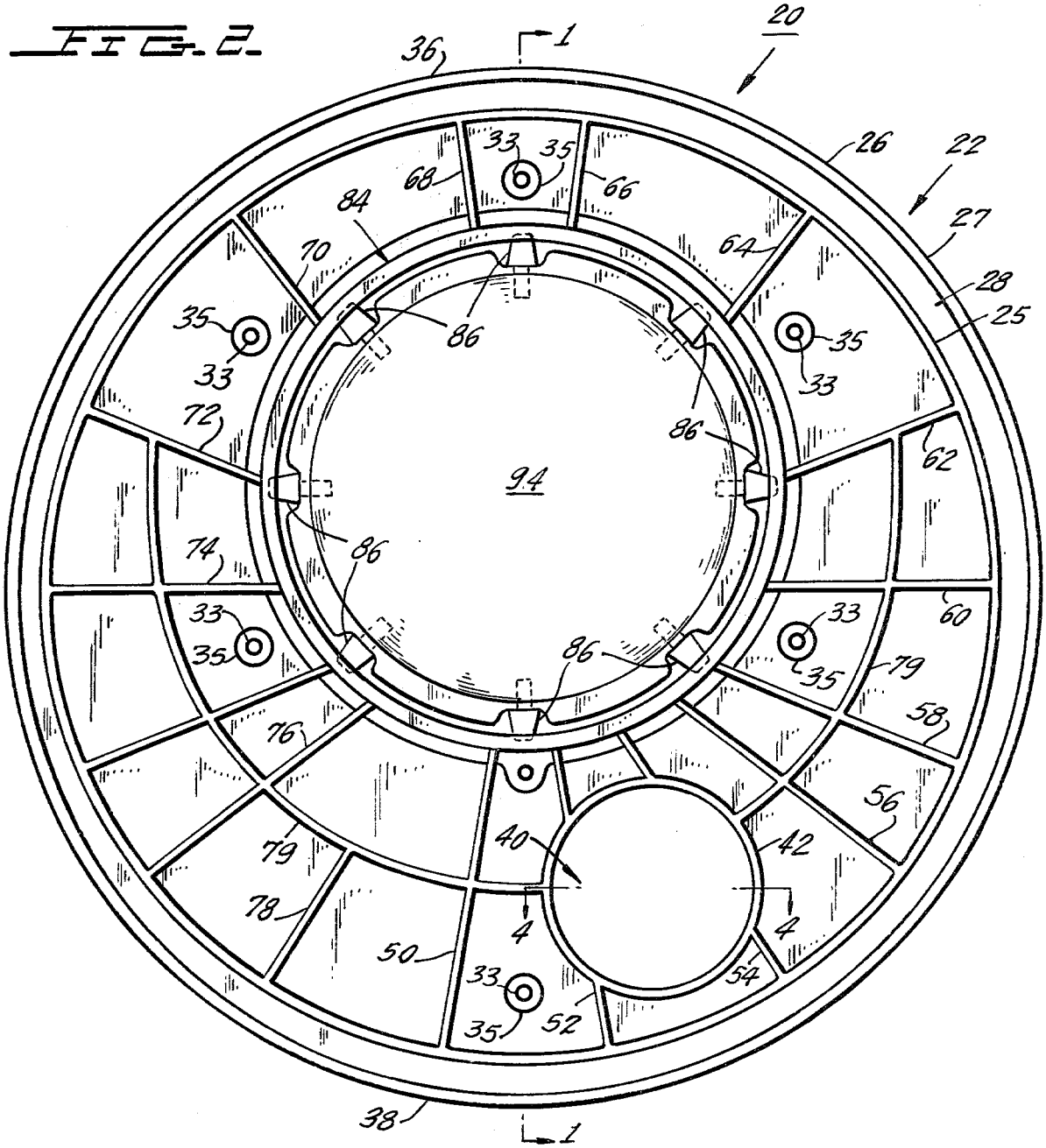
FIG. 2 is a bottom plan view of the assembly of FIG. 1, from the bottom end of the filter cage.

Seated at the top end of the tank 12 and sealingly secured thereto is the integral lid and filter cage assembly 20 according to the invention, which is shown in FIGS. 1 and 2. The assembly 20 is an integral single piece molding of polypropylene or of another appropriate plastic material, and it is comprised of the lid 22 and the filter cage 84.

The lid 22 is a circular solid disc with an outer diameter slightly greater than the external diameter of the tank 12 over which the lid is emplaced. At the periphery on the underside of the lid 22 there is formed an annular internal sealing flange 24 and a radially spaced away, annular external sealing flange 26. Between them, these flanges define the annular tank rim receiving groove 28. The size of the bead 16 on the tank edge and the depth and the radial width of the groove 28 are selected so that the flanges 24 and 26 will securely squeeze tight over the annular bead 16. Further, the diameter of the flange 24 is selected for it to apply a radially outwardly directed force against the interior wall of the tank 12 so that the principal seal of the lid 22 to the tank is on the inside of the tank.

For enhancing the seal between the integral flange 24 and the interior wall of the tank 12, the flange 24 is of greater length and extends deeper into the tank 12 than the exterior flange 26. The lower portion 25 of the exterior side of the flange 24 is chamfered so that the bead 16 at the tank upper periphery will engage the chamfered surface 25 and the tank will press radially inwardly against the chamfered surface as the bead is slipped into the groove 28. This ensures a secure seal by the internal flange 24 against the interior wall of the tank 12. The exterior flange 26 has an annular bead 27 defined at its bottom end for strengthening the flange 26 against undesirable deformation and outward flaring.

In addition to the resilient seal between the flanges 24, 26 on the lid 22 and the bead 16 around the tank, a clamp 29 (FIG. 6) or a plurality of clamps 29 securely and nonremovably holds the lid 22 to the tank. The clamp 29 comprises the clamp hook 31, which has an inwardly curved, upper end hooking portion. The hook 31 is pivotally attached onto the clamp body 37. The hook 31 is raised up and is drawn down by the clamp body 37, and the clamp body is carried and supported on the clamp base 41 on the side of the tank 12 for permitting such shifting of the clamp hook. At the annular positions around lid 22 that correspond to each clamp hook 31, the integrally molded lid 22 has molded on the upper surface thereof at the periphery thereof a respective button 43 which the hook 31 slips over when the clamp body 37 is raised up and which the hook then securely tightens over when the clamp body 37 is returned to its illustrated lowered position.

The lid 22 has an enlarged main fan inlet hole 30 passing through it. At the top surface of the lid, the hole 30 is surrounded by the annular, upstanding rib 32 which also surrounds and defines a narrow, annular horizontal shoulder 34 that supports the inlet grid 114. At the annular interior side of the shoulder 34, the hole 30 extends through the lid 22. The hole 30 is eccentrically located on the lid 22, being nearer to the side 36 and further from the side 38 of the lid.

There are arrayed around the lid and spaced slightly from the upstanding annular rib 32 a plurality of bolt attachment holes 33, each of which is surrounded by a thickened strengthening boss 35. Bolts are passed through the holes 33 into the below described motor housing 144 for securing the motor housing to the lid 22.

Figure 4:
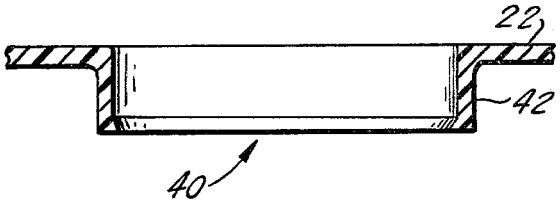
FIG. 4 is a cross-sectional view of a fragment of the lid of the tank showing the intake inlet opening.

Also passing through the lid 22 and spaced slightly from main hole 30, is the tank intake hole 40, shown in FIGS. 1, 4 and 7. This hole is defined by the short height annular sleeve 42 that projects a short distance beneath the lid 22. The intake hole 40 is also eccentrically located on the lid 22. There is a separate conventional intake hose 44, which has a fitting 46 at an end thereof. The fitting 46 is sized and shaped to be sealingly received inside the sleeve 42 for securely holding the hose 44 to the lid 22. At the other end of the hose 44 is an intake nozzle 48 to which any conventional vacuum cleaner tool may be attached. The hole 40 is also located so as to feed into the tank 12 outside of the below described filter assembly 80.

The lid 22 is relatively thin between its top and bottom surfaces, particularly considering the relatively weak plastic material of which the lid is comprised and the motor supporting function which the lid is required to perform. Accordingly, the lid includes on at least one surface thereof a series of reinforcing ribs which rigidify and strengthen the lid. As illustrated in FIG. 2, the rigidifying ribs comprise an array of ribs 50, 52 . . . 78 around the lid 22 and all oriented to extend in a generally radial direction across the undersurface of the lid from the approximate location of the flange 24 to intersect with the annular hole 30. The directions of extension of the ribs 50 . . . 78 are not quite radial, but they generally extend in such directions. Toward the side 38 of the lid 22, which side includes a greater expanse of lid material, and in particular in the area through which the intake hole 40 passes, the ribs 74 . . . 78, 50 . . . 60 are more closely spaced than the spacing of the ribs 62 . . . 72 around the other side of the lid. The placement of the ribs is selected to prevent damage to the lid due to stresses being applied to the lid.

Further, along the wider expanse of the underside of the lid 22, more toward the side 38 of the lid, approximately centrally between the hole 30 and the flange 24, there is generally arcuately shaped reinforcing rib 79 which extends from rib 72 to rib 62 and which intersects all of the ribs between those two ribs and also intersects the hole 40 through the lid 22.

Although the reinforcing ribs are illustrated as being molded into the undersurface of the lid, it is apparent that they can be molded into the top surface of the lid or, in other situations, they may project above both surfaces of the lid. It is a matter of appropriate modifications being made in the mold for the lid and filter assembly according to the invention.

The filter assembly 80 is now described. With reference to FIG. 1, the annular interior of shoulder 34 at the lid is defined by the depending annular collar 82, which is integrated with the lid 22 and which provides the upper end support for the filter cage 84. The filter cage 84 is, in addition to the collar 82, comprised of a plurality, eight being shown, of ribs 86 which are equally annularly spaced around the annular collar 82. The ribs 86 are integrally molded with the collar 82. As shown in FIG. 5, each rib 86 is generally "T" shaped in cross section. Each rib has its T crossbar 88 on the side thereof that faces radially outwardly and which engages the interior of the filter element 150 and has its supporting leg 89 radially inwardly facing. Toward the bottom of each rib 86, it merges into the below described bottom cover 94 of the filter cage assembly. The ribs are not of uniform thickness and length. Instead, both the crossbars 88 and the supporting legs 89 become gradually longer moving down the ribs toward the bottom cover 94.

The ribs 86 are not precisely vertical, but are instead slightly canted radially inwardly, moving downwardly along the ribs, as shown in FIG. 5, with their exterior surfaces being tilted at an angle of 1° from the vertical, for example. The ribs 86 together define thereby a slightly conically tapered, but still generally cylindrically shaped, cage. The tapering shape eases the initial sliding into place of the annular cylindrical filter element 150. As the filter element is pushed into place over the filter cage ribs 86, the tapering shape of the ribs enables them to gradually more securely engage and holds the filter element in place.

The bottom ends of all of the filter cage ribs 86 merge into the annular peripheral area 96 of the bottom wall 94. The bottom wall 94, between its annular peripheral area 96 and its center 98, is frusto-conically domed, rising from the periphery at a slight tilt, for example, 4° from the horizontal. This doming of the bottom wall of the filter cage strengthens the wall. Because the bottom wall 94 is comprised of plastic, it is helpful if it is rigidified in this manner. The bottom wall 94 also extends downwardly at its external annular sleeve portion 101 to the annular outwardly projecting ring 102. The ring 102 engages the interior of the filter element 150. By engaging the interior of the filter element, the ring 102 prevents cocking of the filter element while it is being emplaced and removed and the ring also helps to fixedly secure the filter element immovably over the filter cage.

Seated atop the bottom wall 94 of the filter cage and extending upwardly therefrom inside the volume surrounded by the ribs 86 is the annular sleeve 106, which has perforations, or vertical slots, or the like therein for permitting free passage of liquid or any other material that passes through the filter cage to enter the interior of the sleeve 106. The sleeve 106 is a guiding and supporting device for the tank sealing element.

Within the guide sleeve 106 is located the freely floatable ball 110 or other freely floatable element. In the normal orientation of the vacuum cleaner and with the tank 12 less than nearly completely full, the floatable ball 110 simply rests in the guide 106 against the top surface of the filter cage bottom wall 94. As the tank 12 fills with liquid or wet material to a level above the bottom wall 94 of the filter cage, the liquid or wet material passes through the particulate material impervious but liquid pervious filter element and passes into the filter cage and into the sleeve 106. As the liquid or wet material level rises, the ball 110 rises until it finally seals the inlet 30 to the impeller fan of the vacuum cleaner motor. At this point, the tank 12 should be emptied. Typically, also the filter element 150 would probably have to be replaced or cleaned. The float ball 110 serves as a safety feature for preventing the vacuum cleaner from expelling the material it has previously collected and for preventing the motor of the vacuum cleaner from being wetted by the liquid or wet material which the vacuum cleaner has collected.

Figure 3:
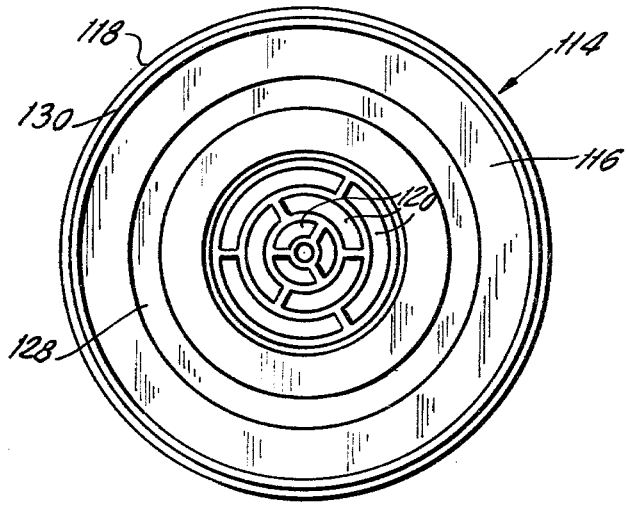
FIG. 3 is a plan view in the direction of arrows 3—3 of FIG. 1 of the inlet grid unit.

Referring to FIGS. 1, 3 and 7, an inlet grid 114 covers over the enlarged main hole 30 in the lid 22. The inlet grid 114 is a separate integral molding which is attached on the lid 22 after insertion of the ball 110 into the sleeve 106. The inlet grid 114 comprises an annular solid disc portion 116. The annular, downwardly projecting, peripheral sleeve 118 of the disc 116 has an external diameter selected so that its bottom surface 119 seats atop the shoulder 34 surrounding the hole 30 in the lid 22, and the exterior side wall of the flange 118 is press fitted against the interior of the upstanding rib 32 on the lid 22. In this manner, the grid 114 is sealed to the lid 22 and becomes a part thereof. Centrally of the disc 116, an air pervious grid element 120 is defined. It is integrally molded with the remainder of the disc 116. The particular configuration of the cuts through the disc 116 that define the grid element 120 are a matter of choice. However, for ease of molding and, to some extent, for esthetic appeal, the particular concentric ring configuration shown in FIG. 3 is recommended.

The exterior of the grid element 120 is defined by the annular downwardly extending central sleeve 122. Sleeve 122 is of a diameter such that and of a length to extend into the lid hole 30 far enough so that the lower end 124 of the sleeve 122 meets the upper end of the sleeve 106, defining a continuous pathway for the floatable ball 110. The interior wall 126 of the sleeve 122 is gradually tapered narrower moving up toward the grid element 120, whereby the ball 110 may freely enter the passageway defined by the sleeve wall 126, but it is eventually is sealingly squeezed against the side walls of that passageway. This halts further movement of the ball toward the grid element 120. But, even more important, it forms a substantially air tight seal between the ball 110 and the wall 126 which blocks the vacuum cleaner from sucking air, liquid or wet material into the vacuum cleaner motor.

The inlet grid disc 116 is strengthened by the annular deformation 128 defined therein.

On the top side of the inlet grid 114, an annular upstanding flange 130 is integrally formed. It is shaped and sized to receive the motor housing base support 148 of the vacuum cleaner motor housing 144 and thereby provides one mechanical connection between the motor housing and the lid and filter cage assembly. The other mechanical connection is provided by the motor housing 144 being bolted to the lid 22 at the above described bolt attachment holes 33.

The present invention is adapted for use with a conventional vacuum cleaner motor 140, the detailed construction of which is not described herein. Beneath the motor 140 is a conventional impeller fan 142 which is driven by the motor 140. The motor 140 and the impeller blade fan are supported in a conventional housing 144. The housing 144 includes a base portion 146, of a width and shape to rest on the lid 22 and the base portion 16 is bolted to the lid by bolts passing through the bolt holes 33. Further, the motor housing has a lower annular flange 48 of an exterior diameter to be sealingly received inside the upstanding flange 130 of the inlet grid assembly 114.

There is a filter element 150 which is removably attached onto the exterior of the filter cage 84. The filter assembly comprises an annular, internal screen 152 around which there is a particulate material impermeable, but air flow permeable, filtering medium 154, such as an accordion pleated length of conventional filtering paper. The internal screen supports the paper layer filter medium 154 and holds it in the desired annular shape. The screen 152 and the accordion pleated paper sheet 154 are both of a height so as to completely surround the filter cage 84 from the collar 82 at the top to the anti-cocking ring 102 at the bottom and the filter assembly is held so securely against the cage so as to block leakage flow bypassing the filtering medium 154, whereby all flow out of the vacuum cleaner is through the filter assembly 80.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cannister type vacuum cleaner, comprising:

a tank; said tank having an inlet; said tank having an upper peripheral edge;

an integral, molded plastic lid and filter support assembly, comprising:

a lid in the form of a disc; said lid having an annular periphery; said lid annular periphery being sealably attachable to said tank upper peripheral edge; said lid having and defining a first hole passing therethrough and located eccentrically thereon for providing communication between the interior of said tank and a fan for drawing air through said first hole; said lid having a lower surface;

a plurality of ribs defined on and extending across said lower surface of said lid for strengthening said lid; said ribs being oriented to extend generally from said first hole toward said periphery of said lid; said ribs being spaced closer to one another toward the side of said lid which defines a greater distance between said first hole and said periphery of said lid and being spaced farther apart toward the side of said lid which defines a lesser distance between said first hole and the periphery of said lid;

a filter support integrally formed with said lid and supported thereby at said lower surface of said lid in said tank; said filter support being placed around said first hole such that a filter carried by said support will, in combination with said filter support, block all flow of air from said tank through said first hole, except through the filter on said support;

said filter support comprising a cage and said cage including a collar integrated with said lid and extending down into said tank from said lid lower surface, a plurality of cage ribs having one end integrated with said collar and extending down into said tank from said collar; said cage ribs having opposite ends; said cage having a bottom integrated to said cage rib opposite ends and said cage bottom closing off the free end of said cage, whereby a filter may be removably placed over said cage and surround said cage ribs annularly;

a motor supported by said lid; a fan drivably attached to said motor; said fan being in communication with said first hole such that said fan draws a vacuum in said tank.

2. The vacuum cleaner of claim 1, further comprising said lid defining and having a second hole passing therethrough and spaced from said first hole and also located eccentrically on said lid; said second hole being said tank inlet.

3. The vacuum cleaner of claim 1, further comprising a generally arcuately curvedly shaped rib around the portion of said lid which defines a greater distance between said eccentric first hole and said periphery of said lid and on said lower surface of said disc; said curvedly shaped rib intersecting the other said ribs extending toward said lid periphery.

4. The vacuum cleaner of claim 3, further comprising said lid defining and having a second hole passing therethrough and spaced from said first hole and also located eccentrically on said lid; said second hole being said tank inlet.

5. The vacuum cleaner of claim 4, wherein said curvedly shaped rib also intersects said second hole through said lid.

6. The vacuum cleaner of claim 1, wherein said lid includes an external flange at said periphery thereof and placed to extend down outside said tank; said lid including an internal flange, radially inwardly spaced from said external flange, thereby defining an annular groove between said external and said internal flanges; said tank peripheral edge being insertable into said annular groove on said lid.

7. The vacuum cleaner of claim 6, further comprising a clamp for sealingly clamping said lid to said tank.

8. The vacuum cleaner of claim 6, wherein said tank has an interior wall defining the interior of said tank; said internal flange of said lid being so placed on said lid as to engage and be biased outwardly against said tank interior wall, thereby to define a lid and tank seal against said tank interior wall.

9. The vacuum cleaner of claim 8, further comprising a clamp for sealingly clamping said lid to said tank.

10. The vacuum cleaner of claim 8, wherein said lid internal flange is chamfered radially inwardly at the free end thereof, thereby to be able to be passed over said tank peripheral edge as said tank peripheral edge is inserted into said lid groove.

11. The vacuum cleaner of claim 1, wherein said cage bottom is generally frusto-conically shaped, having an apex which extends toward said lid.

12. The vacuum cleaner of claim 1, further comprising a floatable element inside said cage and freely floatable toward said lid hole for sealing said hole upon wet material or liquid entering said cage from said tank.

13. The vacuum cleaner of claim 12, wherein said cage bottom is generally frusto-conically shaped, having an apex which extends toward said lid.

14. The vacuum cleaner of claim 12, wherein said cage ribs are generally T-shaped in cross-section with the crossbar of the T being the radially outward side thereof.

15. The vacuum cleaner of claim 12, further comprising an inlet grid element across said lid hole for blocking said hole, thereby to keep said floatable element inside said cage and beneath said lid and for also permitting air flow through said inlet grid element and out of said tank.

16. The vacuum cleaner of claim 15, wherein said inlet grid element is a separate element from said lid and said lid and said inlet grid element having respective mutual interengagement elements for attaching said inlet grid element to said lid at said lid hole.

17. For use in a cannister type vacuum cleaner, an integral molded plastic assembly comprised of a lid for closing the open end of the tank of the vacuum cleaner and a filter support integrally formed with said lid;

said lid being in the form of a disc having opposite upper and lower surfaces; said lid having an annular periphery; said lid annular periphery being sealably attachable to a peripheral edge of a tank of a vacuum cleaner; said lid having and defining a first hole passing therethrough and located eccentrically thereon for providing communication through said lid;

a plurality of ribs defined on and extending across said lower surface of said lid for strengthening said lid; said ribs being oriented to extend generally from said first hole toward said periphery of said lid; said ribs being spaced closer to one another toward the side of said lid which defines a greater distance between said first hole and said periphery of said lid and being spaced farther apart toward the side of said lid which defines a lesser distance between said first hole and the periphery of said lid;

said filter support being integrally formed with and being supported thereby at said lower surface of said lid; said filter support being placed around said first hole in said lid, such that a filter carried by said filter support will, in combination with said filter support, block all flow of air through said lid hole except through the filter on said filter support;

said filter support comprising a cage and said cage including a collar integrated with said lid and extending down into said tank from said lid lower surface, a plurality of cage ribs having one end integrated with said collar and extending down into said tank from said collar; said cage ribs having opposite ends; said cage having a bottom integrated to said cage rib opposite ends and said cage bottom closing off the free end of said cage, whereby a filter may be removably placed over said cage and surround said cage ribs annularly.

18. The assembly of claim 17, further comprising a generally arcuately curvedly shaped rib around a portion of said lid which defines a greater distance between said eccentric hole and the periphery of said disc; said curvedly shaped rib intersecting the other said ribs extending toward said lid periphery.

19. The assembly of claim 17, further comprising said lid defining and having a second hole passing therethrough and spaced from the first said hole and also located eccentrically on said lid.

20. The assembly of claim 19, further comprising a generally arcuately curvedly shaped rib around the portion of said lid which defines a greater distance between said eccentric first hole and said periphery of said lid and on said lower surface of said disc; said curvedly shaped rib intersecting the other said ribs extending toward said lid periphery.

21. The assembly of claim 20, wherein said curvedly shaped rib also intersects said second hole through said lid.

22. The assembly of claim 17, wherein said cage bottom is generally frusto-conically shaped, having an apex which extends toward said lid.

23. The assembly of claim 17, further comprising a floatable element inside said cage and freely floatable toward said lid hole for sealing said hole upon wet material or liquid entering said cage from said tank.

24. The assembly of claim 23, wherein said cage bottom is generally frusto-conically shaped, having an apex which extends toward said lid.

25. The assembly of claim 23, wherein said cage ribs are generally T-shaped in cross-section with the crossbar of the T being the radially outward side thereof.

26. The assembly of claim 17, wherein said lid has an annular periphery; said lid including an external flange at said periphery thereof and placed to extend down outside a tank of a vacuum cleaner; said lid including an internal flange, radially inwardly spaced from said external flange, thereby defining an annular groove between said external and said internal flanges; a peripheral edge of a tank of a vacuum cleaner being insertable into said annular groove on said lid.

27. The assembly of claim 26, wherein said lid internal flange is chamfered radially inwardly at the free end thereof, thereby to be able to be passed over a tank peripheral edge as the tank peripheral edge is inserted into said lid groove.

* * * * *